US005225739A

United States Patent [19]

Faillon et al.

[11] Patent Number: 5,225,739

[45] Date of Patent: Jul. 6, 1993

[54] KLYSTRON WITH CAVITIES ARRANGED IN DIFFERENT BLOCKS FOR PROVIDING WIDENED INSTANTANEOUS PASSBAND

[75] Inventors: Georges Faillon, Meudon; Christophe Bastien, Asnieres, both of France

[73] Assignee: Thomson Tubes Electroniques, Boulogne Billancourt, France

[21] Appl. No.: 745,882

[22] Filed: Aug. 16, 1991

[30] Foreign Application Priority Data

Aug. 24, 1990 [FR] France ..... 90 10633

[51] Int. Cl.[5] ..... H01J 25/10

[52] U.S. Cl. ..... 315/5.43; 315/5.51; 315/5.16

[58] Field of Search ..... 315/5.14, 5.16, 5.39, 315/5.43, 5.51, 5.52; 330/44, 45

[56] References Cited

U.S. PATENT DOCUMENTS

| | | | |
|---|---|---|---|
| 3,195,007 | 7/1965 | Watson et al. | 315/5.43 |
| 3,594,606 | 7/1971 | Lien | 315/5.43 |
| 3,775,635 | 11/1973 | Faillon et al. | 315/5.43 |
| 3,819,977 | 6/1974 | Kageyama | 315/5.43 |
| 4,284,922 | 8/1981 | Perring et al. | 315/5.39 |
| 4,558,258 | 12/1985 | Miyake | 315/5.39 |

OTHER PUBLICATIONS

NEC Research and Development, No. 1, Jan. 1986, Tokyo, Japan, pp. 101-107, Takashi Nagashima, et al., "Super-High-Power Klystron for the JT-60".

Japanese Abstract, vol. 1, No. 18, (E-003), Mar. 24, 1977, JP-A-51 115768, Takao Kageyama, Dec. 10, 1976, "Wide-Band Speed Modurated Tube".

*Primary Examiner*—Steven Mottola
*Assistant Examiner*—Benny T. Lee
*Attorney, Agent, or Firm*—Oblon, Spivak, McClelland, Maier & Neustadt

[57] ABSTRACT

A klystron with widened instantaneous passband comprises a succession of cavities separated by drift tubes, divided into three blocks. The first block comprises all that is upline from a first central cavity, the third block comprises all that is downline from a second central cavity and the second block comprises the central cavities. In each block, the sum of the lengths of the drift tubes is equal to: $H+(T\times 180°)$. H is a quantity ranging from 45 to 135 plasma degrees and T is an integer greater than or equal to zero. In at least one of the blocks, T is greater than or equal to one and the length of at least one tube of this block is greater than or equal to 135 plasma degrees. The disclosed device can be applied to wideband klystrons.

10 Claims, 5 Drawing Sheets

KLYSTRON WITH CAVITIES ARRANGED IN DIFFERENT BLOCKS FOR PROVIDING WIDENED INSTANTANEOUS PASSBAND

BACKGROUND OF THE INVENTION

1. Field of the Invention

The present invention relates to amplifier klystrons with wide instantaneous passbands. It can be applied to single-beam klystrons as well as to multiple-beam klystrons. The instantaneous passband is the frequency band in which the gain of the tube is greater than a limit, for example one dB below its maximum value.

A single-beam klystron is a microwave tube with velocity modulation of an electron beam. Its principle is based on the interaction between a longitudinal electron beam and electromagnetic fields induced in resonant cavities. The electrical component of the electromagnetic field is parallel to the axis of the electron beam. A focusing device surrounds the cavities. This device prevents the electron beam from diverging. The magnetic field created by this device is parallel to the axis of the electron beam.

The cavities, which are generally four or five in number, are placed one after the other. They are separated by drift tubes which are small-diameter tubes. The interval between two drift tubes is an interaction space. The electron beam, formed in a gun, successively crosses the resonant cavities and the drift tubes. A microwave to be amplified is introduced into the first cavity or input cavity. The last cavity or output cavity is connected to an output device. The electron beam acquires a velocity modulation in entering the first cavity. This velocity modulation is converted into a density modulation in the drift tube placed downline, that is further along the direction of movement of the electron beam, e.g. the second cavity is downline of the first cavity, from the first cavity, and this enables the second cavity to be excited.

The electrons come together in increasingly dense packets. These packets are obtained by the action of all the cavities except the last one, and by the passive effect of the drift tubes. The cavities modulate the velocity of the electron beam. In the drift tubes, the fast electrons catch up with the slower electrons.

In the last cavity, the highly modulated electron beam yields its energy, by being stopped, to the electromagnetic field of this cavity, and this energy gets propagated up to the output device.

A multiple-beam klystron has one or more guns that produce several parallel, longitudinal electron beams. These electron beams go through a succession of cavities. A cavity is crossed by all the beams. Two successive cavities are connected by as many drift tubes as there are electron beams. The working of a multiple-beam klystron is comparable to that of a single-beam klystron.

If the cavities of a klystron are all tuned to the same resonance frequency, then the instantaneous passband, measured at −1 dB, will be small, in the range of 1% for example.

However, there are amplifier klystrons with wider instantaneous passbands, with values of the order of several per cent, and even of up to 10%.

To obtain such a result, the method employed is that of stagger-tuned amplifiers: in this method, each cavity is tuned to a frequency different from that of its neighbors.

Almost all the tuning frequencies are distributed in the passband that the klystron should have.

However, the fine tuning of a wideband klystron with stagger tuning is a complex process. For, the curve of the gain as a function of the frequency of a cavity, associated with its two drift tubes, resembles that of a parallel R, L, C circuit, close to its resonance frequency with a maximum, but it also has a minimum for a certain frequency which is generally higher than the resonance frequency.

It is seen that, if the sum of the lengths of the two drift tubes adjacent to the cavity is substantially equal to 180 plasma degrees, the minimum gain is pushed towards infinity.

The length of drift tubes is expressed, in a standard way, in terms of the reduced plasma angle, i.e. in terms of "plasma degrees" plasma indicating the interior of the electron beam. The length of a drift tube L in plasma degrees is given by:

$$L(360 \times d)/1_q$$

where $1_q$ is the wavelength of plasma and d is the physical distance between the centers of two interaction spaces placed on either side of the drift tube, in the corresponding cavities.

Furthermore, in klystrons with more than three cavities, the response of a cavity, located in the central part of the tube, is affected by what has happened in the previous cavities. The electron beam has been modulated in the previous cavities, and the closer the beam gets to the last cavity, the more modulated it is. The electron packets are increasingly dense, the phenomena are no longer linear and the modulations are no longer simply added on to each other. It is necessary to take account of the space charge, namely the mutual repulsion between electrons.

An instantaneous wideband klystron, with four cavities, has its input cavity and its output cavity tuned to the central frequency Fo of the passband that the klystron should have. The second cavity is generally tuned to a frequency lower than the central frequency Fo while the third cavity is tuned to a frequency higher than the central frequency Fo. A known method of obtaining as wide a passband as possible is to ensure that the second cavity and the third cavity each have adjacent drift tubes with a length such that their sum is substantially equal to 180 plasma degrees.

The total length of the drift tubes of the klystron is then substantially equal to 270 plasma degrees.

If the klystron has more than four cavities, it is common practice to limit the total length of its drift tubes to about 270 plasma degrees. This value of 270 plasma degrees does not have to be met very strictly, and may furthermore be modified as a function of other characteristics.

It can be seen that it is possible to add on cavities to widen the passband of the klystron and these cavities are preferably tuned to frequencies higher than the central frequency Fo. It can also be easily seen that the cavities added on after the sixth and seventh cavities no longer make any great contribution to increasing the passband of the klystron. Furthermore, as a result of the limitation of the value of 270 plasma degrees, the added cavities are extremely close to one another. It may even be that they have to overlap one another, which cannot be achieved in practice. In any case, it becomes difficult to build the tube. The widest instantaneous passband obtained generally does not go beyond 10%.

SUMMARY OF THE INVENTION

The present invention seeks to overcome these drawbacks and proposes a klystron with an instantaneous passband that is at least one and a half times wider than the one that can be obtained in the prior art.

The present invention consists in giving the drift tubes lengths and the cavities resonance frequencies that make it possible to optimize the passband of the tube without modifying its operation.

The present invention proposes a wideband klystron comprising:

at least one longitudinal electron beam;

a succession of aligned cavities, all crossed by the electron beam and distributed into three blocks;

a drift tube, crossed by the electron beam, to connect two successive cavities, this succession of cavities comprising an input cavity, an output cavity, two successive central cavities, the first central cavity being positioned on the input cavity side and being tuned to a frequency lower than the central frequency of the band, the second central cavity being on the output cavity side and being tuned to a frequency higher than the central frequency of the band, and at least one intermediate cavity positioned between the input cavity and the first central cavity, tuned to a frequency that is lower than the central frequency of the band, the first block comprising the cavities and the drift tubes upline from the first central cavity, the second block comprising the two central cavities and the drift tube that connects them, the third block comprising at least the output cavity and the drift tube downline from the second central cavity.

The invention proposes a klystron wherein, in each block, the sum of the lengths of the drift tubes, if there are several of them, or the length of the drift tube, if there is only one of them, is equal to:

$$H+(T\times 180) \text{ plasma degrees,}$$

H being a first quantity ranging from 45 to 135 plasma degrees and T being an integer greater than or equal to zero, T being greater than or equal to one in at least one of the blocks, and in this block the length of at least one drift tube being greater than or equal to 135 plasma degrees.

When, in the first block, T is greater than or equal to one, at least one drift tube connected to an intermediate cavity and positioned downline from the intermediate cavity has a length greater than or equal to 135 plasma degrees.

The klystron may include at least one additional cavity positioned in the third block, between the second central cavity and the output cavity.

Preferably, the first quantity H is equal to 90 degrees +a in the first block and to 90 degrees −a in the third block, a being a second quantity having an absolute value smaller than or equal to 45 plasma degrees.

The intermediate cavity and the first central cavity are preferably tuned to decreasing frequencies that are lower than the central frequency of the band.

The second central cavity and the additional cavity are preferably tuned to increasing frequencies that are higher than the central frequency of the band.

Preferably, the input cavity is tuned to a frequency that is substantially equal to the central frequency of the band.

Preferably, the output cavity is tuned to a frequency that is substantially equal to the central frequency of the band.

The klystron may be either a single-beam klystron or a multiple-beam klystron.

BRIEF DESCRIPTION OF THE DRAWINGS

Other features of the invention shall appear from the following description, given by way of a non-restrictive example, illustrated by the appended figures, of which.

MORE DETAILED DESCRIPTION

Figure 1:
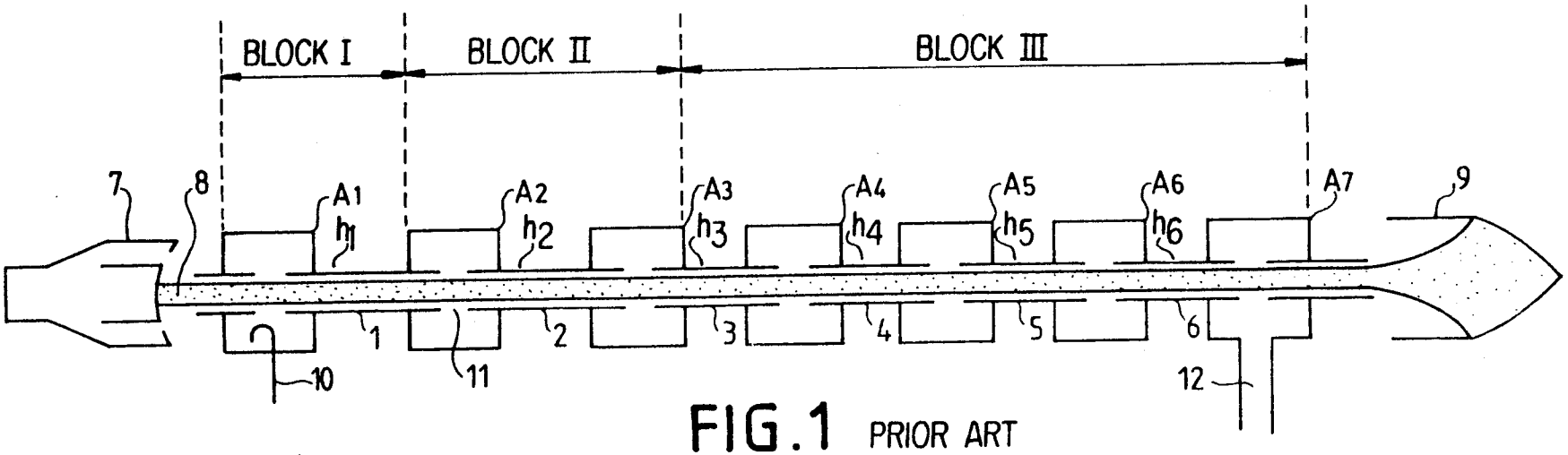
FIG. 1 PRIOR ART
FIG. 1 shows a schematic longitudinal section of a klystron with cavities tuned to staggered frequencies according to the prior art.

FIG. 1 shows a schematic view of a prior art multiple-beam klystron.

This klystron has an electron gun 7 that produces an electron beam 8 sent towards a collector 9.

The electron beam 8 goes through seven successive cavities. These are: an input cavity A1 which is the cavity closest to the gun 7, other cavities A2, A3, A4, A5, A6, and an output cavity A7 which is the cavity closest to the collector 9.

The cavities are connected to one another by drift tubes 1, 2, 3, 4, 5, 6 which are small tubes. They penetrate the cavities. The tube 1 is placed between the input cavity A1 and the cavity A2. The tube 2 is placed between the cavity A2 and the cavity A3 and so on. The drift tubes do not have the same length. The tube 1 has a length h1, the tube 2 has a length h2 and so on until h6. In the cavity A2, for example, the two tubes 1,2 facing each other are separated by an interaction space 11 that is often narrow in relation to the dimensions of the cavity.

The input cavity A1 is connected to a coupling device 10 designed to introduce a microwave to be amplified. This microwave is produced by a generator which is not shown.

The output cavity A7 is connected to a coupling device 12 designed to collect the radiation after amplification.

The tube is tuned to staggered frequencies. The input cavity A1 and the output cavity A7 are respectively tuned to the frequencies F1, F7, which are substantially equal to the central frequency Fo of the passband of the klystron.

Figure 2:
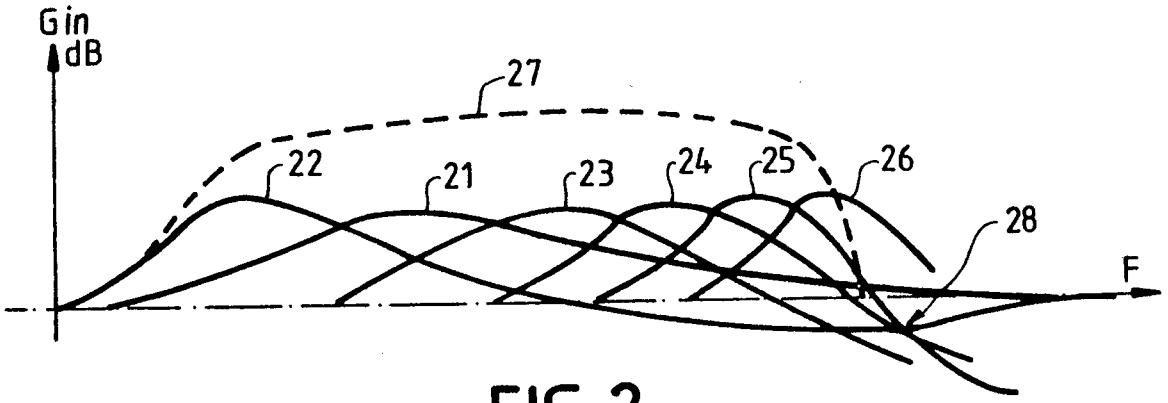
FIG. 2 PRIOR ART
FIG. 2 shows schematic curves of the gain as a function of the frequency of each of the cavities of the klystron of FIG. 1, as well as the frequency response curve of the same klystron.

The coupling between the cavity A1 and the generator is adjusted so that the frequency response curve of the cavity A1 covers, even if unequally, the passband of the klystron. This curve is shown with reference to FIG. 2.

The output cavity A7 does not participate in the gain of the klystron. Its role is to extract the microwave power created by all the preceding cavities. It must cover the entire passband desired. Its frequence response curve has not been shown in FIG. 2.

The cavity A2 is tuned to a frequency F2 that is included in the passband of the klystron and is lower than Fo. The lengths h1, h2 of its two adjacent drift tubes 1, 2 are large, in the range of 90 plasma degrees. The frequency response of the cavity A1, which is tuned to a frequency F1, will have its minimum gain pushed beyond the maximum frequency of the passband of the klystron. The frequency response curve of the cavity A1 bears the reference 21 in FIG. 2. The frequency response curve of the cavity A2 bears the reference 22 in FIG. 2.

The cavity A3 is tuned to a frequency F3 within the passband of the klystron and higher than Fo. Its frequency response curve bears the reference 23 in FIG. 2.

The cavity A4 is tuned to a frequency F4 that is higher than F3, the cavity A5 is tuned to a frequency F5 that is higher than F4 and so on. The frequencies F4 to F6 are within the passband of the klystron or slightly higher than it. Their frequency response curves are respectively referenced 24, 25, 26 in FIG. 2. The curve 27, shown in dashes, represents the frequency response curve of the klystron.

So that the frequency band of the klystron may be as wide as possible, it is seen to it that the sum of the lengths of all the drift tubes is close to 270 plasma degrees.

The klystron may be split up into three successive blocks so that it can be likened to a four-cavity klystron.

The first block I comprises the input cavity A1 and the drift tube 1. The second block II comprises the cavity A2, the drift tube 2 and the cavity A3. Here, the cavity A2 has a frequency F2 lower than Fo. It is the only cavity to be tuned to a frequency lower than Fo in the example described. It is possible to envisage an example where the tube has other cavities tube tuned to a frequency lower than Fo. The cavity A3 is the first cavity, crossed by the electrons, that is tuned to a frequency higher than Fo. Generalizing from this, the block II will include the last cavity crossed by the electrons, tuned to a frequency lower than Fo, and the first cavity crossed by the electrons, tuned to a frequency higher than Fo. Here, the last cavity, tuned to a frequency lower than Fo, is the cavity A2 and the first cavity, tuned to a frequency higher than Fo, is the cavity A3.

If the tube comprised several cavities positioned between the cavity A1 and the cavity A2, these cavities and the drift tubes upline from the cavity A2 would form part of the block I.

The third block III comprises the drift tubes 3, 4, 5, 6 and the cavities A4, A5, A6, A7.

By extrapolating the use of the 270 plasma degrees indicated here above, it is seen that it is possible to modify the total length of the drift tube or tubes of each block.

If there is only one drift tube in the block, the total length will be the length of this tube. If there are several drift tubes, the total length will be the sum of the lengths of all the drift tubes of the block.

In each block, it is possible to increase or decrease this total length by a quantity that is positive, negative or zero, with an absolute value that is smaller than or equal to 45 plasma degrees.

We then obtain, for example:

$$h1=90°+a=h$$

$$h2=90°+b=h''$$

$$h3+h4+h5+h6=90°-a=h'$$

where h is the length of all drift tubes in block I, h'' is the length of all drift tubes in block II, h' is the length of all drift tubes in block III, a and b are quantities with an absolute value that is smaller than or equal to 45 plasma degrees.

$$h1+h2+h3+h4+h5+h6=270°+b.$$

The total length of all the drift tubes of the klystron ranges from 225 degrees to 315 plasma degrees.

Figure 3:
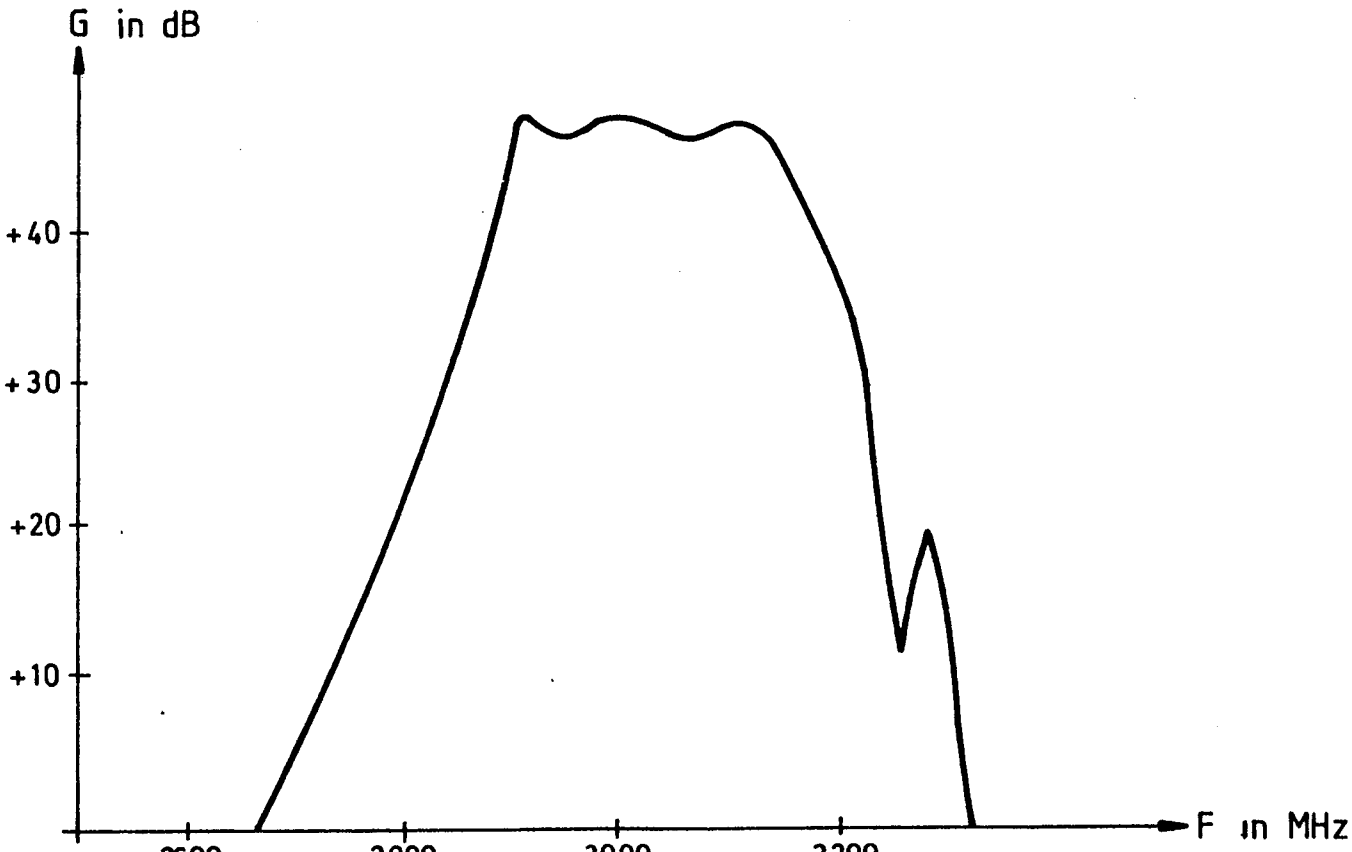
FIG. 3 PRIOR ART
FIG. 3 shows a real curve of the gain as a function of the frequency of the klystron of FIG. 1.

FIG. 3 shows the frequency response curve, as determined by actual measured values of the klystron of FIG. 1.

It can be seen that the passband obtained is still not very wide.

The lengths of the drift tubes and the frequencies of the cavities are recorded in Table No. 1 at the end of the present description.

The values of a and b are respectively −19 and 0 plasma degrees.

To further widen the passband, it would be necessary to add on even more cavities, but this is hardly possible since the cavities would be too close together and would tend to overlap one another. Furthermore, when looking at FIG. 2, it is seen that the dashed curve 27 falls abruptly as it reaches the high frequencies and marks a trough 28. This trough 28 in the gain characteristic is substantially the sum of the troughs of the curves 21 to 26. Each additional cavity tuned to a frequency higher than Fo would have a frequency response that would serve more to fill the trough 28 than to widen the passband.

Figure 4:
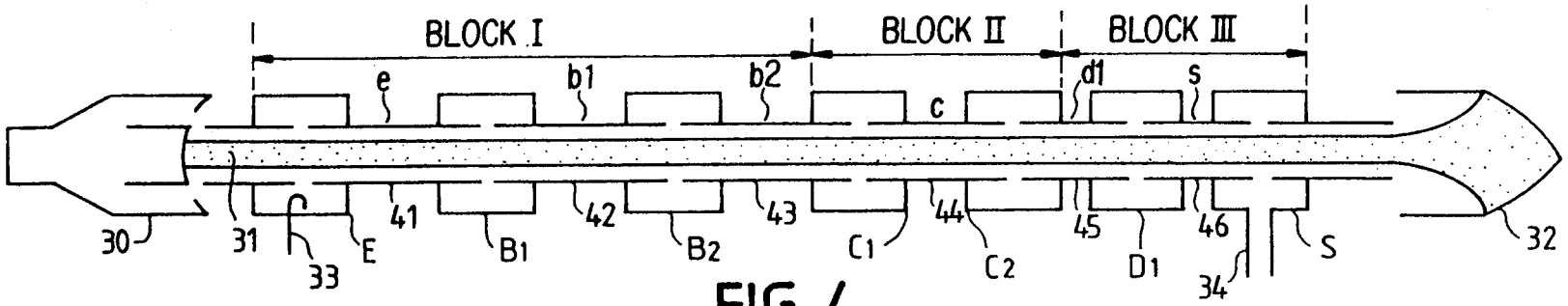
FIG. 4 shows a schematic longitudinal section of a single-beam klystron, according to the invention, with seven cavities tuned to staggered frequencies.

FIG. 4 gives a schematic view of an instantaneous wideband klystron according to the invention. The differences between this klystron and the one described in FIG. 1 lie in the lengths of the drift tubes and in the number and frequencies of the cavities.

The passband of the klystron has a central frequency Fo, defined as the arithmetical mean of the frequencies for which the power is 1 dB below the maximum power.

A klystron according to the invention has an electron gun 30 that produces at least one electron beam 31 sent towards at least one collector 32. This beam 31 goes through a succession of seven cavities (E, B1, B2, C1, C2, D1, S). If there are several electron beams, each cavity is crossed by all the beams at the same time. Two successive cavities are connected by at least one drift tube (41, 42, 43, 44, 45, 46). If there are several electron beams, two successive cavities are connected by as many drift tubes as there are electron beams. The drift tubes connecting two successive cavities have a substantially equal length. In FIG. 4, the klystron shown is a single-beam klystron.

The succession of cavities includes a first cavity E, or input cavity connected to a coupling device 33 designed to introduce a microwave frequency signal to be amplified, a last cavity S or output cavity connected to a coupling device 34 designed to extract the microwave signal after amplification. Preferably, the cavity E and the cavity S are respectively tuned to frequencies FE and FS that are substantially equal to Fo.

The succession of the cavities also includes a first central cavity C1 that is tuned to a frequency FC1 that is below Fo, placed between the cavities E and S, and a second central cavity C2 tuned to a frequency FC2 that is higher than Fo. The cavity C2 is placed downline i.e., farther along the direction of movement of the electron beam, from the cavity C1.

Finally, the succession of the cavities includes at least one intermediate cavity (B1, B2) placed between the cavities E and C1, tuned to a frequency lower than Fo. FIG. 4 shows two intermediate cavities B1 and B2. The first intermediate cavity B1 is followed by the second intermediate cavity B2. The frequencies of the two intermediate cavities are respectively FB1 and FB2, and these frequencies are lower than Fo.

According to the invention, the values of the frequencies of the intermediate cavities are chosen as follows: FB1 higher than FB2, and FB2 higher than FC1. The frequencies of the cavities B1, B2, C1 which follow one another from the input cavity onwards have decreasing values.

The succession of the cavities may thus include, in a standard way, at least one additional cavity D1 positioned between the second central cavity C2 and the output cavity S. This cavity is tuned to a frequency FD1 that is higher than Fo. In FIG. 4, there is only one intermediate cavity D1. FD1 has been chosen to be higher than FC2. If other cavities had been placed between D1 and the output cavity S, their frequencies would have been increasingly higher frequencies.

Two successive cavities are connected by a respective drift tube in a single-beam klystron, and by several parallel drift tubes in a multiple-beam klystron. Two drift tubes connecting different cavities do not necessarily have the same length. Between E and S, there are the drift tubes 41 42, 43, 44, 45, 46 respectively having the lengths e, b1, b2, c, d1, s.

At the center of the interaction space of a cavity, at an abscissa point that we shall call $z=0$, certain electrons have or acquire a velocity that is smaller than the average, while others possess or acquire a velocity that is greater than the average.

As discussed, for example in *Microwave Tubes*, by A. S. Gilmour, page 216, at the abscissa point $z=lq/4$ (lq is the plasma wavelength of the beam), the slow electrons have been caught up with by the fast electrons that were following them. The electrons have re-assembled in packets.

At the abscissa point $z=lq/4$, the density is therefore the maximum. The phenomenon continues after lq/4 and, at the abscissa point $z=lq/2$, the electrons recover the same velocity distribution as at the abscissa point $z=0$. And after this abscissa point $z=lq/2$, the slow electrons at the abscissa point $z=0$ have become fast and the fast electrons at the abscissa point $z=0$ have become slow. New packets will be formed as above, and the same maximum density is found again at the abscissa point $z=3lq/4$.

This phenomenon of packet-forming and, hence, of current modulation, is a periodic one, with a period lq/2. It signifies that a drift tube may be extended by n times lq/2 (n is an integer) or by n times 180 plasma degrees. The amplitude of the current modulation will then always be the same at its end.

The prior art implies a situation where the optimization of the length of certain drift tubes leads to a decrease in their length and even to the superimposition of several cavities, something that is impossible in reality. This periodic phenomenon enables the modification of the length of the drift tubes of the klystron without disturbing its operation. The klystron may thus be optimized in terms of passband.

The klystron of FIG. 4 may be broken down into three blocks I, II, III as defined further above.

The block I includes the entire part of the tube upline from the cavity C1, i.e. the part between electron gun 30 and cavity C1 which includes the input cavity E, the cavity B1, the cavity B2 as well as the drift tubes 41, 42, 43 respectively having lengths e, b1, b2.

The block II includes the cavity C1, the drift tube 44 with a length c and the cavity C2. The cavity C1 is the last cavity to be tuned to a frequency lower than Fo. The cavity C2 is the first cavity to be tuned to a frequency higher than Fo.

The block III includes the entire part of the tube from the cavity C2, i.e. the part further along the direction of movement of the electron beam which includes the cavity D1, the cavity S and the drift tubes 44, 45 respectively having lengths d1 and s.

According to a major characteristic of the invention, in each block, the sum of the lengths of the drift tubes, if there are several of them, or the length of the drift tube if there is only one, is equal to:

$H+(T\times 180)$ plasma degrees, H being a first quantity ranging from 45 to 135 plasma degrees and T being an integer greater than or equal to zero, T assuming a value greater than or equal to one in at least one of the blocks and, in this block, the length of at least one drift tube being greater than or equal to 135 plasma degrees.

The sum of the lengths of the drift tubes of each block, crossed by the same beam, then becomes:

- for the block I: $e+b1+b2=h+(m\times 180°)$
  $e+b1+b2=90°+a+(2\times 180°)$ m is an integer greater than or equal to zero; m has been given the value 2 in the example described.

Preferably, m be given a value greater than or equal to one.

- for the block II: $c=h''+(p\times 180°)$
  $c=90°+b+(0\times 180°)$ p is an integer greater than or equal to zero; p has been given the value 0 in the example described. It could be given a value different from 0.

- for the block III: $d1+s=h'+(n\times 180°)$
  $d1+s=90°-a+(0\times 180°)$ n is an integer greater than or equal to zero; n has been given the value 0 in the example described. It could be given a value different from 0.

a, b are positive, zero or negative quantities with an absolute value that is smaller than or equal to 45 plasma degrees. The quantities h, h', h'' then range from 45 to 135 plasma degrees.

The example described in FIG. 4 is a preferred embodiment of the invention. Two drift tubes 42, 43 of the block I are given a respective length b1, b2 such that:

$$b1=180°+e1$$

$$b2=180°+e2$$

e1 and e2 are two negative or zero quantities, with an absolute value that is smaller than or equal to 45 plasma degrees. The lengths b1 and b2 therefore range from 135 to 180 plasma degrees The two tubes 42, 43 are placed do from an intermediate cavity.

The total length of all the drift tubes of the klystron, crossed by the same beam, becomes:

$$e+b1+b2+c+d1+s=270^\circ+b+(t\times 180^\circ)$$

with t=n+m+p (t is an integer greater than or equal to one).

We get a total length of substantially 270 plasma degrees, plus or minus t times 180 degrees, and as many cavities as are needed. More precisely, the total length of the drift tubes of the klystron ranges from: 225+(t×180) plasma degrees to 315+(t×180) plasma degrees.

Figure 5:
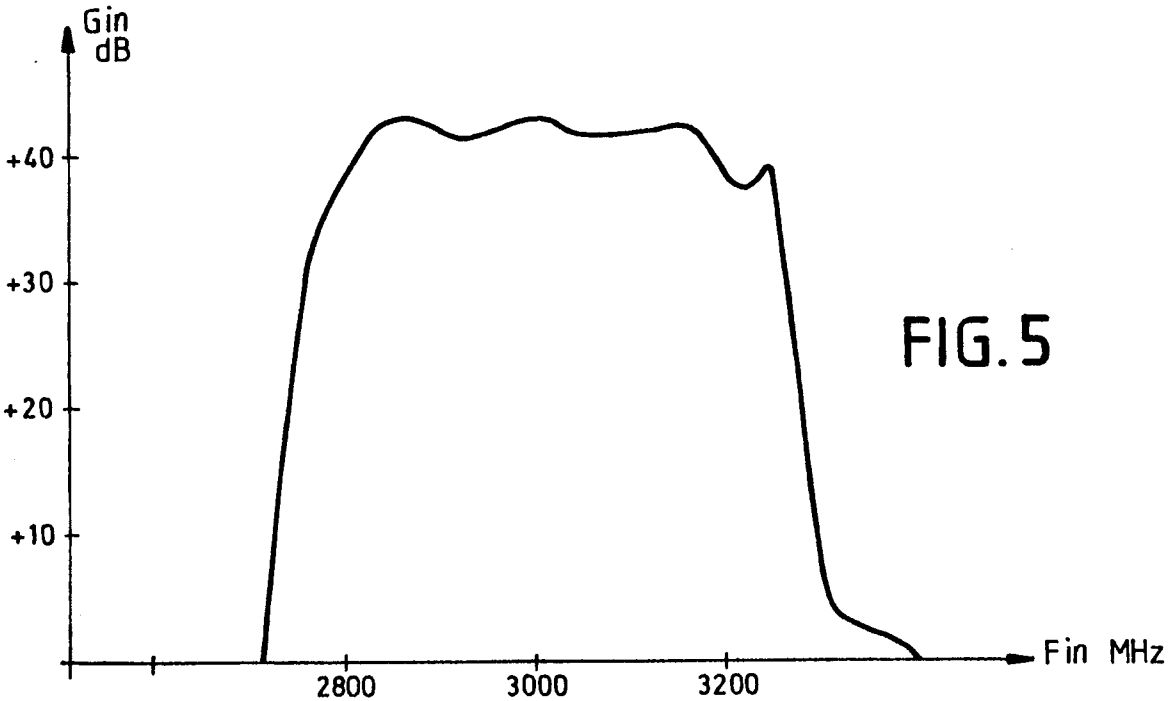
FIG. 5 shows a real curve of the gain as a function of the frequency of the klystron of FIG. 4.

FIG. 5 shows the real frequency response curve of the klystron of FIG. 4.

The values of the frequencies and of the lengths of the drift tubes are recorded in Table No. 2 at the end of this description.

Figure 6:
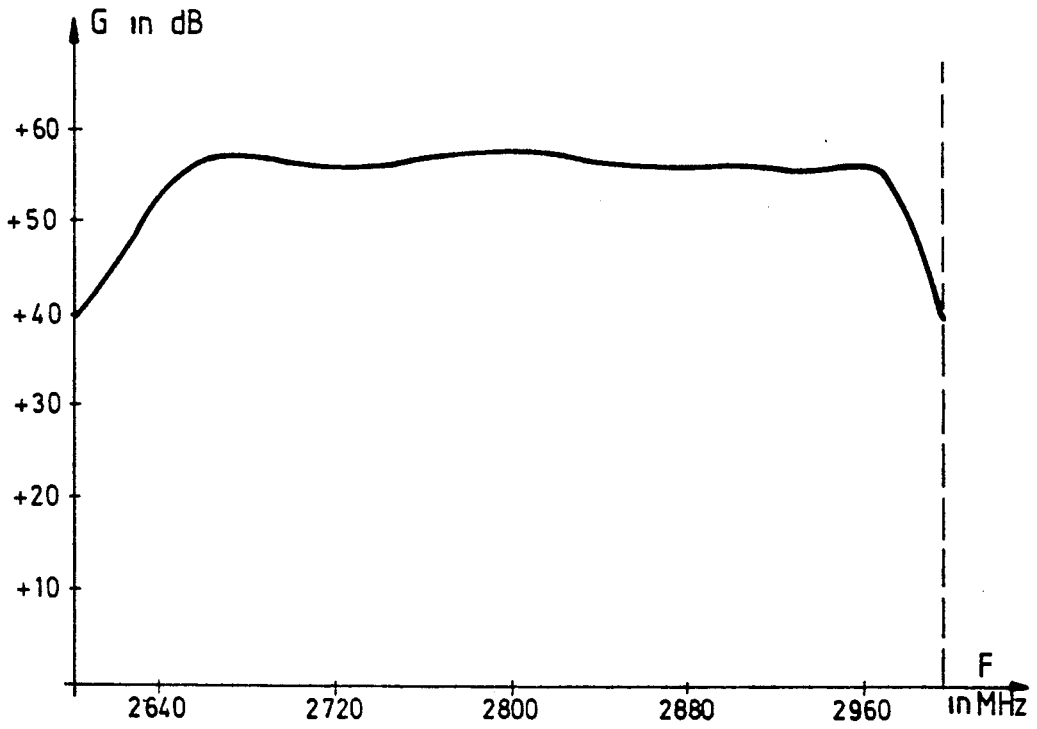
FIG. 6 shows a real curve of the gain as a function of the frequency, of a nine-cavity klystron according to the invention.

In this example:

Fo=3000 MHz a=−18 plasma degrees b=0 plasma degrees e1=−35 plasma degrees e2=−35 plasma degrees FIG. 6 shows the real frequency response curve of another klystron according to the invention. This klystron is a single-beam klystron and has nine stagger-tuned cavities E, B1, B2, C1, C2, D1, D2, D3, S The instantaneous passband is wider than +130% as compared with that shown in FIG. 3.

The values of the frequencies and of the lengths of the drift tubes are recorded in Table No. 3 at the end of this description. There is very little difference between the frequency FE and the frequency Fo.

Figure 7:
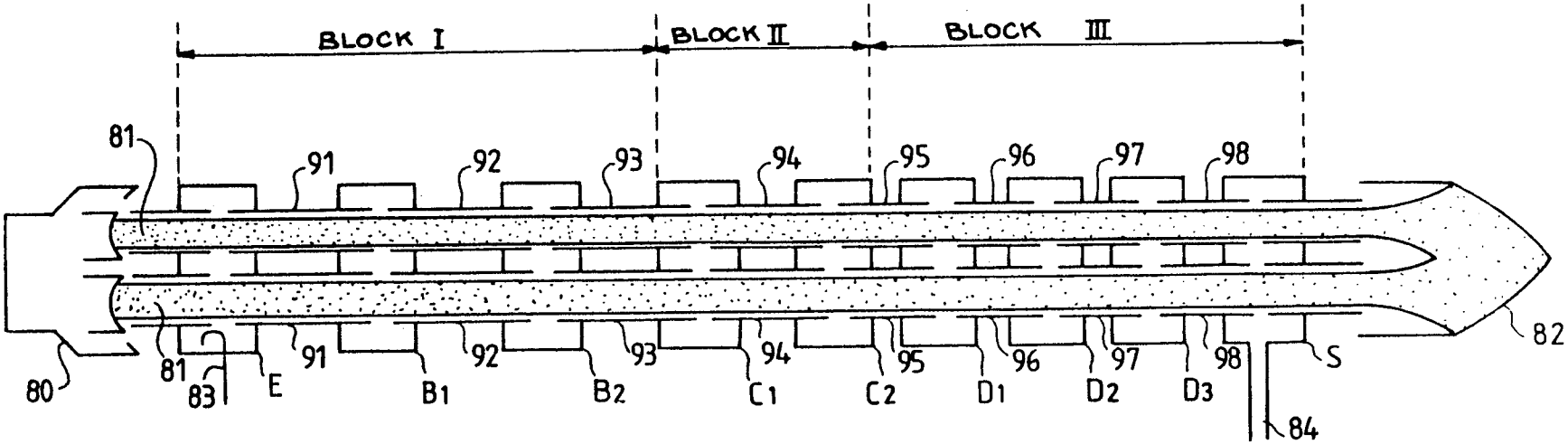
FIG. 7 shows a longitudinal section of a multiple-beam klystron according to the invention.

In this example:

Fo=2 815 MHz a=−19 plasma degrees b=0 plasma degrees e1=−35 plasma degrees e2=−35 plasma degrees FIG. 7 shows a longitudinal section of a multiple-beam klystron according to the invention. This klystron has nine stagger-tuned cavities (E, B1, B2, C1, C2, D1, D2, D3, S). A single electron gun 80 produces several electron beams 81 sent towards a single collector 82. The figure shows only two electron beams 81. There may be more of them. The electron beams are parallel. The successive cavities are connected to one another by as many drift tubes as there are electron beams 81. The tubes 91 connect the cavity E to the cavity B1. The tubes 92 connect the cavity B1 to the cavity B2 and so on until the tubes 98. The cavity E is connected to a coupling device 83, and the cavity S is connected to another coupling device 84. The lengths of the drift tubes and the frequencies of the cavities may assume, for example, the values recorded in the Table No. 3.

The present invention is not limited to the examples described. Modifications may be made, notably in the choice of the frequencies (FS may be different from Fo for example), the number of intermediate cavities, the number of drift tubes with a length greater than or equal to 135 plasma degrees.

In particular, it is not obligatorily that the first block has a total length equal to: H+(T×180°), with T greater than or equal to 1. It may also be the second block or the third block.

TABLE 1

| Cavity | Frequency in MHz | Length of the drift tube in plasma degrees |
|---|---|---|
| A1 | F1 = 3000 | h1 = 70 |
| A2 | F2 = 2900 | h2 = 90 |
| A3 | F3 = 3130 | h3 = 23 |
| A4 | F4 = 3180 | h4 = 23 |
| A5 | F5 = 3210 | h5 = 23 |
| A6 | F6 = 3290 | h6 = 40 |
| A7 | F7 = 3000 | |

TABLE 2

| Cavity | Frequency in MHz | Length of the drift tube in plasma degrees |
|---|---|---|
| E | FE = 3000 | e = 142 |
| B1 | FB1 = 2840 | b1 = 145 |
| B2 | FB2 = 2790 | b2 = 145 |
| C1 | FC1 = 2760 | c = 90 |
| C2 | FC2 = 3160 | d1 = 68 |
| D1 | FD1 = 3250 | s = 40 |
| S | FS = 3000 | |

TABLE 3

| Cavity | Frequency in MHz | Length of the drift tube in plasma degrees |
|---|---|---|
| E | FE = 2775 | e = 141 |
| B1 | FB1 = 2670 | b1 = 145 |
| B2 | FB2 = 2640 | b2 = 145 |
| C1 | FC1 = 2600 | c = 90 |
| C2 | FC2 = 2920 | d1 = 23 |
| D1 | FD1 = 3250 | d2 = 23 |
| D2 | FD2 = 2990 | d3 = 23 |
| D3 | FD3 = 3080 | s = 40 |
| S | FS = 2815 | |

What is claimed is:

1. A wideband klystron having a passband with a predetermined central frequency, comprising:

an electron gun for generating an electron beam;

an input cavity through which said electron beam passes;

at least one intermediate cavity connected to the input cavity through a first drift tube of a first respective length and through which the electron beam passes, the intermediate cavity having a resonant frequency which is less than the predetermined central frequency of the passband of the klystron;

a first central cavity connected to the intermediate cavity through a second drift tube of a second respective length and through which the electron beam passes, the first central cavity having a resonant frequency which is less than the predetermined central frequency of the passband of the klystron;

wherein the input cavity, the first drift tube, the intermediate cavity and the second drift tube define a first block;

a second central cavity connected to the first central cavity through a third drift tube of a third respective length and through which the electron beam passes, the second central cavity having a resonant frequency which is greater than the predetermined central frequency of the passband of the klystron, wherein the first central cavity, the third drift tube and the second central cavity define a second block;

an output cavity connected to the second central cavity through a fourth drift tube of a fourth respective length and through which the electron beam passes, wherein the fourth drift tube and the output cavity define a third block;

wherein, for each of the first, second and third block, a sum of the respective lengths of each of the drift tubes in each respective block is equal to:

$$H+(T\times 180)\text{plasma degrees},$$

H being a first quantity ranging from 45 to 135 plasma degrees and T being an integer greater than or equal to zero, and wherein in at least one predetermined block the integer T has a value greater than or equal to one, and at least one drift tube in this at least one predetermined block has a length which is greater than or equal to 135 plasma degrees.

2. The klystron according to claim 1, wherein the first block is the one predetermined block and T is greater than or equal to one, and the second drift tube is the at least one drift tube which has a length greater than or equal to 135 plasma degrees.

3. The klystron according to either of claims 1 or 2, wherein at least one additional cavity is positioned between the second central cavity and the output cavity to be connected to the second central cavity through the fourth drift tube and to be connected to the output cavity through a fifth drift tube of a fifth respective length, the at least one additional central cavity and fifth drift tube further defining the third block.

4. The klystron according to claim 3, wherein the resonant frequency of the second central cavity is lower than the resonant frequency of the at least one additional cavity.

5. The klystron according to claim 1, wherein the resonant frequency of the at least one intermediate cavity is higher than the resonant frequency of the first central cavity.

6. The klystron according to claim 1, wherein H is respectively equal to 90 degrees plus a in the first block and 90 degrees minus a in the third block, a having an absolute value smaller than or equal to 45 plasma degrees.

7. The klystron according to claim 1, wherein the input cavity has a resonant frequency that is substantially equal to the predetermined central frequency of the pass band of the klystron.

8. The klystron according to claim 1, wherein the output cavity has a resonant frequency that is substantially equal to the predetermined central frequency of the passband of the klystron.

9. The klystron according to claim 1, wherein the klystron is a single-beam klystron.

10. The klystron according to claim 1, wherein the klystron is a multiple-beam klystron.

* * * * *